US006627062B1

(12) United States Patent
Dreyfus

(10) Patent No.: US 6,627,062 B1
(45) Date of Patent: Sep. 30, 2003

(54) GRAPHITE CATHODE FOR THE ELECTROLYSIS OF ALUMINIUM

(75) Inventor: Jean-Michel Dreyfus, Lyons (FR)

(73) Assignee: Carbone Savoie, Venissieux (FR)

( * ) Notice: Subject to any disclaimer, the term of this patent is extended or adjusted under 35 U.S.C. 154(b) by 0 days.

(21) Appl. No.: 09/890,606

(22) PCT Filed: Feb. 1, 2000

(86) PCT No.: PCT/FR00/00232

§ 371 (c)(1),
(2), (4) Date: Oct. 5, 2001

(87) PCT Pub. No.: WO00/46426

PCT Pub. Date: Aug. 10, 2000

(30) Foreign Application Priority Data

Feb. 2, 1999 (FR) ..... 99 01320

(51) Int. Cl.[7] ..... C25C 3/08

(52) U.S. Cl. ..... 205/380; 205/381; 205/383; 204/243.1; 204/280; 204/294

(58) Field of Search ..... 204/294, 243.1, 204/280; 205/380, 381, 383

(56) References Cited

U.S. PATENT DOCUMENTS

| | | | |
|---|---|---|---|
| 1,029,122 A | 6/1912 | Héroult | 204/294 |
| 3,764,509 A | 10/1973 | Etzel et al. | 204/243.1 |
| 3,787,311 A | 1/1974 | Wittner et al. | 204/294 |
| 4,589,967 A | 5/1986 | Etzel | 204/243.1 |

FOREIGN PATENT DOCUMENTS

| | | |
|---|---|---|
| EP | 0 132 647 | 7/1984 |
| FR | 2 117 960 A | 7/1972 |
| FR | 2 351 192 A | 12/1977 |

OTHER PUBLICATIONS

Book of Winnacker—Küchler Chemische Technologie Kohlenstoff Produkte, pp. 278–303.

D. Lombard et al., "Aluminium Pechiney", Light Metals, 1998, pp. 653–658.

V.I. Lakomsky, "Improvement of current distribution along a cathode block of an aluminium cell", Aluminium 1996, pp. 822–826.

J.F. Tschalych, "Herstellung von Kohle– und Graphitelektroden", 1961, pp. 234–251.

*Primary Examiner*—Bruce F. Bell
(74) *Attorney, Agent, or Firm*—Oliff & Berridge, PLC

(57) ABSTRACT

In this cathode, which is a single block, the electrical resistivity is heterogeneous along its longitudinal axis, this resistivity being higher in the end regions of the cathode (3) than in the central region of the latter.

15 Claims, 2 Drawing Sheets

GRAPHITE CATHODE FOR THE ELECTROLYSIS OF ALUMINIUM

A subject-matter of the present invention is a graphite cathode for the electrolysis of aluminium.

BACKGROUND OF THE INVENTION

In the elctrolytic process used in the majority of plants for the production of aluminium, an electrolysis cell comprises, in a metal tank sheathed with refractories, a cathode floor composed of several cathode blocks placed side by side. This assembly constitutes the crucible which, rendered leak-tight by lining paste, is the site of the conversion, under the action of the electric current, of the electrolytic bath to aluminium. This reaction takes place at a temperature generally greater than 950° C.

To withstand the thermal and chemical conditions prevailing during the operation of the cell and to satisfy the need for conduction of the electrolysis current, the cathode block is manufactured from carbonaceous material. These materials range from semi-graphitic to graphite. They are shaped by extrusion or by vibrocompaction after mixing the starting materials:

- either a mixture of pitch, of calcined anthracite and/or of graphite, in the case of semi-graphitic and graphitic materials. These materials are subsequently baked at approximately 1200° C. The graphitic cathode does not comprise anthracite. The cathode manufactured from these materials is commonly known as a carbon cathode,
- or a mixture of pitch and coke, with or without graphite, in the case of graphites. In this case, the materials are baked at approximately 800° C. and then graphitized at more than 2400° C. This cathode is known as a graphite cathode.

It is known to use carbon cathodes which, however, have medium electrical and thermal characteristics which are no longer suitable for the operating conditions of modern cells, in particular with a high current intensity. The need to reduce energy consumption and the possibility of increasing the intensity of the current, in particular in existing plants, has promoted the use of graphite cathodes.

The graphitization treatment of the graphite cathode, at more than 2400° C., allows the electrical and thermal conductivities to be increased, thus creating satisfactory conditions for optimized operation of an electrolysis cell. The energy consumption decreases because of the fall in the electrical resistance of the cathode. Another way of taking advantage of this fall in electrical resistance consists in increasing the intensity of the current injected into the cell, thus making possible an increase in the production of aluminium. The high value of the thermal conductivity of the cathode then makes it possible to discharge the excess heat generated by the increase in intensity. Furthermore, graphite cathode cells appear to be less unstable electrically, that is to say comprising a reduced fluctuation in the electric potentials, than carbon cathode cells.

However, it turned out that cells equipped with graphite cathodes exhibit a shorter lifetime than cells equipped with carbon cathodes. Graphite cathode cells become unusable because of an excessively high enrichment in iron of the aluminium which results from attack on the cathode bar by the aluminium. The metal attacks the bar as a result of erosion of the graphite block. Although erosion of carbon cathodes is also observed, it is much weaker and does not detrimentally affect the lifetime of the cells, which become unusable for reasons other than erosion of the cathode.

In contrast, the wear of graphite cathodes is sufficiently rapid to become the main reason for loss of cells for the electrolysis of aluminium at an age which may be described as premature with respect to the lifetimes recorded for cells equipped with carbon cathodes. Thus, the following rates of wear are recorded for the various materials:

| Cathode | Rate of wear (mm/year) |
|---|---|
| carbon, semi-graphitic | 10–20 |
| carbon, graphitic | 20–40 |
| graphite | 40–80 |

The single figure in the appended diagrammatic drawing shows a cathode block 3 with cathode bars for feeding current 2, the initial profile of which is denoted by the reference 4. The erosion profile 5, represented in dotted lines, shows that this erosion is increased at the ends of the cathode block.

The document FR 2 117 960 discloses a cathode for the preparation of aluminium by electrolysis. This cathode is prepared from several blocks made of semi-graphite carbon with different resistivities from one another. This structure, complex because of the placing of blocks side by side, with the electrical discontinuity which results therefrom, is justified not by a decrease in the erosion, since cathodes of this type are not sensitive to erosion, but by a decrease in the swelling of the floor in the central region.

The rate of erosion of a graphite cathode block is consequently its weak point and its economic appeal in terms of increase in production can disappear if the lifetime cannot be increased.

The calculation of the current densities in the cathode shows that the latter are higher in the direction of the exit of the cathode bars. These current densities increase as the electrical resistance of the cathode decreases. Thus, the erosion profile of each cathode and in particular the high wears observed at the ends of the cathodes correspond to the regions of high current densities in the cathode.

The problem posed is thus that of reducing the erosion of cathodes made of graphite, in particular in the end regions of the

SUMMARY OF THE INVENTION

The aim of the invention is to provide a graphite cathode with an increased lifetime by limiting the erosion which takes place at the ends.

To this end, in the cathode according to the invention, the cathode made of graphite is a single block and its electrical resistivity is heterogeneous along its longitudinal axis, this resistivity being higher in the end regions of the cathode than in the central region of the latter. The mean resistivity of the product will remain compatible with an optimized operation of the electrolysis cell. The higher resistivity in the end regions of the cathode channels the lines of current towards the centre of the cell. For this reason, the high current densities generally recorded towards the exit of the cathode bars are decreased, thus inhibiting the mechanism of erosion in these regions. The lifetime of the cell is therefore increased. By way of indication, the end regions of the cathode can be regarded as situated between approximately 0 and 800 mm from each end.

According to one possibility, during the graphitization operation, the end regions of the cathode are brought to a temperature of the order of 2200–2500° C., whereas the central region is brought to a temperature of the order of 2700 to 3000° C.

In accordance with a first embodiment, the difference in heat treatment in the end regions and in the central region of the cathode is obtained by limiting the thermal insulation of the graphitization furnace and/or by positioning heat sinks in the end regions of the cathodes, in order to increase the heat losses.

According to another embodiment, the difference in heat treatment in the end regions and in the central region of the cathode is obtained by locally modifying the lines of current, and consequently the Joule effect which results therefrom, during the graphitization operation.

It is possible to combine these two phenomena during the same graphitization operation.

In accordance with an embodiment of the cathode according to the invention, in the case where the graphitization operation is carried out simultaneously for several cathodes positioned in parallel with regard to one another inside a furnace, for example of Acheson type, in which the cathodes are separated from one another by a resistor-grain packing, for example carbon or coke granules, the difference in heat treatment between the end regions and the central region is obtained by varying the resistivity of the resistor grain between two cathodes and/or by positioning heat sinks in the end regions.

BRIEF DESCRIPTION OF THE DRAWINGS

In any case, the invention will be fully understood using the description which follows, with reference to the appended diagrammatic drawing representing, as non-limiting examples, several plants for the production of a cathode according to the invention.

DETAILED DESCRIPTION OF THE INVENTION

Figure 1:
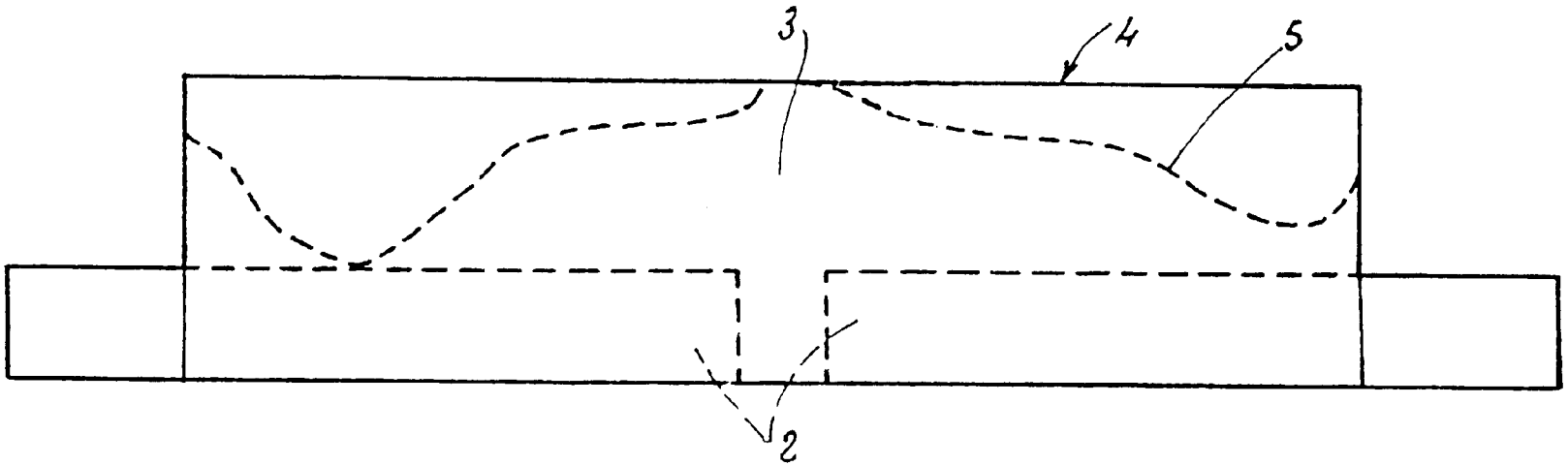
FIG. 1 is a view of a cathode with more specific indication of the erosion of the latter after a certain operating time.
Figure 2:
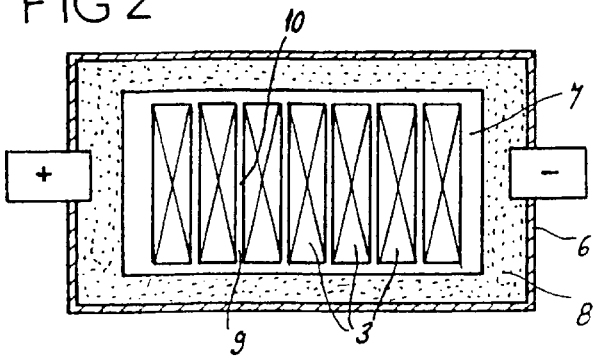
FIGS. 2 to 4 are three views, respectively from above, from the front and from the side, of a graphitization furnace of Acheson type.
Figure 3:
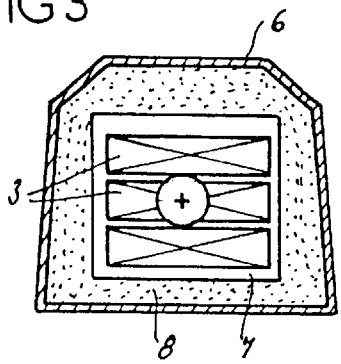
Figure 4:
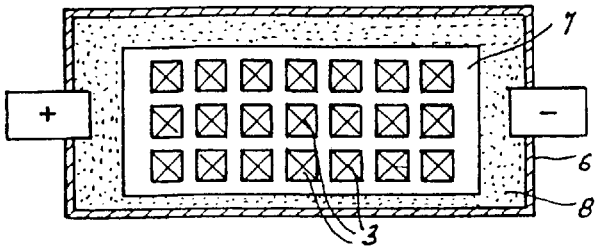

FIGS. 2 to 4 show a furnace 6 of Acheson type, in which a number of cathodes 3 are positioned in parallel with regard to one another over several rows with interposition, between the various cathodes, of a resistor grain 7. This resistor grain can be composed, for example, of carbon or coke granules. The assembly is positioned inside a heat-insulating grain 8. Electrical energy is injected inside the furnace in order to carry out the graphitization operation, the heating resulting from the Joule effect. In a furnace of this type, the lines of current are perpendicular to the axis of the cathodes 3. In order to reduce heating in the end regions of the cathodes 3, the resistivity of the resistor grain is higher in the regions 9 corresponding to the end regions of the cathodes 3 than that of this resistor grain in the region 10 corresponding to the central part of the cathodes. It is also possible to reduce the thickness of the heat-insulating grain 8 in the end regions of the cathodes, in order to promote the phenomenon of limitation of the graphitization temperature in these end regions by heat loss.

Figure 5:
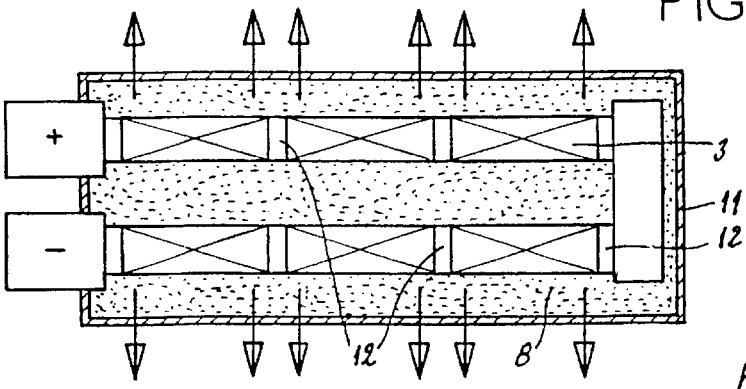
FIGS. 5 to 7 are three views, respectively from above, from the front and from the side, of a graphitization furnace of longitudinal type.
Figure 6:
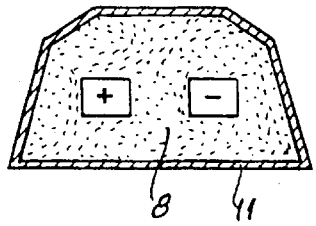
Figure 7:
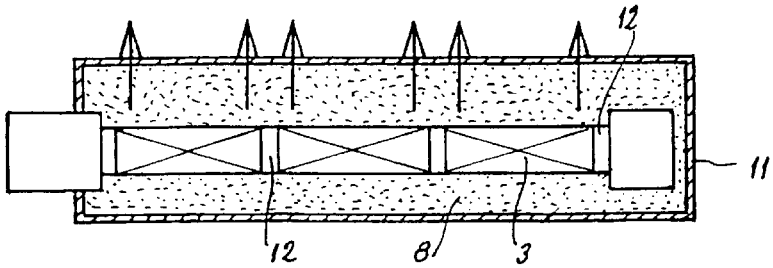

FIG. 5 represents a longitudinal furnace 11 in which several cathodes 3 are positioned end to end, with interposition between two neighbouring cathodes of a graphitization joint 12. The graphitization joints have the lowest possible resistance, in order to avoid undesirable heating at the junction between the cathodes. In addition, heat losses, represented by arrows, are created in the end regions of the cathodes by providing a reduced thickness of heat insulator 8 and/or the presence of heat sinks, which can be made of graphite and can be positioned perpendicular to the cathodes, facing the regions to be cooled.

As emerges from the above, the invention greatly improves the existing technique by providing a cathode of conventional structure, and obtained by known means, having a higher resistivity in its end regions than in its central region, thus making it possible to decrease the current density in the cathode at its ends and to increase the resistance to erosion in these end regions.

What is claimed is:

1. Graphite cathode for the electrolysis of aluminum, characterized in that it is a single block and that its electrical resistivity is heterogeneous along its longitudinal axis, this resistivity being higher in the end regions of the cathode than in the central region of the cathode.

2. Graphite cathode according to claim 1, characterized in that the difference in resistivity in the end regions and in the central region of the cathode is obtained by a different heat treatment in these different regions during the graphitization operation, the end regions being at a temperature below that of the central region.

3. Graphite cathode according to claim 2, characterized in that, during the graphitization operation, the end regions of the cathode Fare brought to a temperature of the order of 2200–2500° C., whereas the central region is brought to a temperature of the order of 2700 to 3000° C.

4. Graphite cathode according to claim 3, characterized in that the difference in heat treatment in the end regions and in the central region of the cathode is obtained by limiting the thermal insulation of the graphitization furnace and/or by positioning heat sinks facing the end regions of the cathodes, in order to increase the heat losses.

5. Graphite cathode according to claim 3, characterized in that the difference in heat treatment in the end regions and in the central region of the cathode is obtained by locally modifying the lines of current, and consequently the Joule effect which results therefrom, during the graphitization operation.

6. Graphite cathode according to claim 2, characterized in that the difference in heat treatment in the end regions and in the central region of the cathode is obtained by limiting the thermal insulation (of the graphitization furnace and/or by positioning heat sinks facing the end regions of the cathodes, in order to increase the heat losses.

7. Graphite cathode according to claim 2, characterized in that the difference in heat treatment in the end regions and in the central region of the cathode is obtained by locally modifying the lines of current, and consequently the Joule effect which results therefrom, during the graphitization operation.

8. A method of production of aluminum by electrolysis, comprising:

providing an electrolysis cell comprising a cathode floor made up of a plurality of cathodes according to claim 1;

providing an electrolytic bath in said electrolysis cell; and applying electric current to said electrolytic bath through said cathodes.

9. A method of making a graphite cathode for the electrolysis of aluminum, comprising treating a single block cathode to cause its electrical resistivity to be heterogeneous along its longitudinal axis, this resistivity being higher in the end regions of the cathode than in the central region of the cathode.

10. A method according to claim 9, comprising producing the difference in resistivity in the end regions and in the central region of the cathode by a different heat treatment in these different regions during graphitization of the cathode, the end regions being at a temperature below that of the central region.

11. A method according to claim 10, wherein during the graphitization, the end regions of the cathode are brought to a temperature of 2200–2500° C., and the central region is brought to a temperature of 2700 to 3000° C.

12. A method according to claim 10, wherein the difference in heat treatment in the end regions and in the central region of the cathode is produced by at least one member selected from the group consisting of limiting thermal insulation of a graphitization furnace and positioning heat sinks facing the end regions of the cathode, in order to increase heat losses from the end regions of the cathode.

13. A method according to claim 10, wherein the difference in heat treatment in the end regions and in the central region of the cathode is produced by locally modifying lines of current, and consequently the Joule effect which results from said lines of current, during the graphitization.

14. A method according to claim 10, wherein graphitization is carried out simultaneously for several cathodes positioned in parallel with regard to one another inside a furnace in which the cathodes are separated from one another by a resistor-grain packing, and the difference in heat treatment between the end regions and the central region of the cathode is produced by at least one member selected from the group consisting of varying electrical resistivity of the resistor grain between two cathodes and positioning heat sinks facing the end regions.

15. Graphite cathode for the electrolysis of aluminum characterized in that it is a single block and that its electrical resistivity is heterogeneous along its longitudinal axis, this resistivity being higher in the end regions of the cathode than in the central region of the cathode, the difference in resistivity in the end regions and in the central region of the cathode having been obtained by a different heat treatment in these different regions during the graphitization operation, the end regions being at a temperature below that of the central region, and the graphitization operation having been carried out simultaneously for several cathodes positioned in parallel with regard to one another inside a furnace in which the cathodes are separated from one another by a resistor-grain packing, the difference in heat treatment between the end regions and the central region of the cathode being obtained by varying the electrical resistivity of the resistor grain between two cathodes and/or by positioning heat sinks facing the end regions.

* * * * *